United States Patent [19]

Frame

[11] 4,298,463

[45] Nov. 3, 1981

[54] METHOD OF TREATING A SOUR PETROLEUM DISTILLATE

[75] Inventor: Robert R. Frame, Glenview, Ill.

[73] Assignee: UOP Inc., Des Plaines, Ill.

[21] Appl. No.: 167,630

[22] Filed: Jul. 11, 1980

[51] Int. Cl.[3] ..... C10G 19/00; C10G 27/00; C10G 29/00

[52] U.S. Cl. ..... 208/189; 208/203; 208/206; 208/207

[58] Field of Search ..... 208/206, 207, 189, 203

[56] References Cited

U.S. PATENT DOCUMENTS

| | | | |
|---|---|---|---|
| 2,918,426 | 12/1959 | Quiquerez et al. | 208/206 |
| 2,966,453 | 12/1960 | Gleim | 208/206 |
| 2,988,500 | 6/1961 | Gleim | 208/206 |
| 3,164,544 | 1/1965 | Bowers | 208/207 |
| 3,252,892 | 5/1966 | Gleim | 208/206 |
| 3,352,777 | 11/1967 | Sparks | 208/207 |
| 3,980,582 | 9/1976 | Anderson, Jr. et al. | 252/428 |
| 4,107,078 | 8/1978 | Carlson | 208/206 |
| 4,124,493 | 11/1978 | Frame | 208/206 |
| 4,141,819 | 2/1979 | Carlson | 208/206 |
| 4,156,641 | 5/1979 | Frame | 208/207 |
| 4,157,312 | 6/1979 | Frame | 208/207 |
| 4,159,964 | 7/1979 | Frame | 252/428 |

*Primary Examiner*—O. R. Vertiz
*Assistant Examiner*—Wayne A. Langel
*Attorney, Agent, or Firm*—James R. Hoatson, Jr.; Gregory J. Mancuso; William H. Page, II

[57] ABSTRACT

A method of treating a mercaptan-containing sour petroleum distillate which comprises contacting said distillate at oxidation conditions with a mercaptan oxidation catalyst, such as a metal phthalocyanine disposed on a carrier, in the presence of a substituted ammonium compound, such as a benzyldimethylalkylammonium hydroxide, and a linear ionic compound, the latter preferably comprising a saturated compound having from about 9 to about 24 carbon atoms.

13 Claims, No Drawings

METHOD OF TREATING A SOUR PETROLEUM DISTILLATE

BACKGROUND OF THE INVENTION

The field of art to which the claimed invention pertains is the treatment of sour petroleum distillates or fractions, the treatment being commonly referred to as sweetening. More specifically, the claimed invention relates to treating sour petroleum distillates with a catalytic composite, comprising a carrier material, a metal chelate, a substituted ammonium compound, and a linear ionic compound.

DESCRIPTION OF THE PRIOR ART

Processes for the treatment of a sour petroleum distillate, wherein said distillate is treated, in the presence of an oxidizing agent at alkaline reaction conditions, with a supported metal phthalocyanine catalyst disposed as a fixed bed in a treating or reaction zone, have become well known and widely accepted in the industry. The treating process is typically designed to effect the catalytic oxidation of offensive mercaptans contained in the sour petroleum distillate with the formation of innocuous disulfides. Gasoline, including natural, straight run and cracked gasolines, is the most frequently treated sour petroleum distillate. Other sour petroleum distillates include the normally gaseous petroleum fraction as well as naphtha, kerosine, jet fuel, fuel oil, lube oil, and the like.

A commonly used continuous process for treating sour petroleum distillates entails treating the distillate in contact with a metal phthalocyanine catalyst dispersed in an aqueous caustic solution to yield a doctor sweet product. The sour distillate and the catalyst-containing aqueous caustic solution provide a liquid-liquid system wherein mercaptans are converted to disulfides at the interface of the immiscible solutions in the presence of an oxidizing agent—usually air. Sour petroleum distillates containing more difficultly oxidizable mercaptans are more effectively treated in contact with a metal phthalocyanine catalyst disposed on a high surface area adsorptive support—usually a metal phthalocyanine on an activated charcoal. The distillate is treated in contact with the supported metal phthalocyanine catalyst at oxidation conditions in the presence of an alkaline agent. One such process is described in U.S. Pat. No. 2,988,500. The oxidizing agent is most often air admixed with the distillate to be treated, and the alkaline agent is most often an aqueous caustic solution charged continuously to the process or intermittently as required to maintain the catalyst in a caustic-wetted state.

The prior art discloses that there are limitations on the ability to treat a sour petroleum distillate of a catalytic composite consisting of a metal phthalocyanine disposed on a carrier material. The prior art suggests that improved oxidation of mercaptans contained in some sour petroleum distillates can be effected by the use of certain additives in the distillate treating process. Generally, such additives are injected into the sour petroleum distillate to be treated. Additives which have been disclosed include certain substituted ammonium halides (U.S. Pat. No. 4,124,493), certain quaternary ammonium hydroxides (U.S. Pat. No. 4,156,641), and certain alkanolamine hydroxides (U.S. Pat. No. 4,159,964).

The prior art does not disclose or suggest, however, that a sour mercaptan-containing petroleum distillate may be effectively treated by a method comprising contacting the distillate at oxidation conditions with a mercaptan oxidation catalyst in the presence of a linear ionic compound and a substituted ammonium compound represented by the structural formula set forth below.

SUMMARY OF THE INVENTION

It is a broad object of this invention to present a novel process particularly useful in the treatment of mercaptan-containing sour petroleum distillates.

In one of its broad aspects, the present invention embodies a process which comprises contacting a mercaptan-containing sour petroleum distillate at oxidation conditions with a mercaptan oxidation catalyst in the presence of a linear ionic compound and a substituted ammonium compound represented by the structural formula

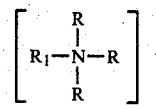

wherein R is a hydrocarbon radical containing up to about 20 carbon atoms and selected from the group consisting of alkyl, cycloalkyl, aryl, alkaryl and aralkyl, $R_1$ is a substantially straight-chain alkyl radical containing from about 5 to about 20 carbon atoms, and X is an anion selected from the group consisting of halide, nitrate, nitrite, sulfate, phosphate, acetate, citrate, tartrate and hydroxide.

Another embodiment of this invention is the foregoing process wherein one of the R groups of the substituted ammonium compound is selected from the group consisting of aryl, aralkyl, and alkaryl, and the linear ionic compound is a saturated linear ionic compound having from about 9 to about 24 carbon atoms.

A more specific embodiment of this invention is the foregoing process wherein the substituted ammonium compound is a benzyldimethylalkylammonium hydroxide wherein the alkyl substituent is a substantially straight-chain alkyl radical containing from about 12 to about 18 carbon atoms and the linear ionic compound is a saturated linear ionic compound having from about 9 to about 24 carbon atoms, the anionic portion of which is selected from the group consisting of sulfonate, sulfate, and carboxylate, and the cationic portion of which is selected from the group consisting of alkali metals and ammonium.

Other objects and embodiments will become apparent in the following detailed description.

DESCRIPTION OF THE INVENTION

The mercaptan oxidation catalyst contemplated in the method of this invention can be either a supported catalytic composite or an unsupported catalyst. For use in a fixed bed treating operation, the mercaptan oxidation catalyst can be disposed on a carrier material. The carrier material herein contemplated includes the various and well known adsorbent materials in general use as catalyst supports. Preferred carrier materials include the various charcoals produced by the destructive distillation of wood, peat, lignite, nut shells, bones, and other carbonaceous matter, and preferably such charcoals as have been heat treated, or chemically treated, or both, to form a highly porous particle structure of increased adsorbent capacity, and generally defined as activated charcoal. Said carrier materials also include the naturally occurring clays and silicates, for example, diatomaceous earth, fullers earth, kieselguhr, attapulgus clay, feldspar, montmorillonite, halloysite, kaolin, and the like, and also the naturally occurring or synthetically prepared refractory inorganic oxides such as alumina, silica, zirconia, thoria, boria, etc., or combinations thereof, like silica-alumina, silica-zirconia, alumina-zirconia, etc. Any particular carrier material is selected with regard to its stability under conditions of its intended use. For example, in the treatment of a sour petroleum distillate, the carrier material should be insoluble in, and otherwise inert to, the petroleum distillate at alkaline conditions typically existing in the treating zone. Charcoal, and particularly activated charcoal, is preferred because of its capacity for metal phthalocyanine and because of its stability under treating conditions. However, it should be observed that the method of this invention is also applicable to a mercaptan oxidation catalyst composited with any of the other well known carrier materials, particularly the refractory inorganic oxides.

The mercaptan oxidation catalyst employed in the practice of this invention can be any of the various metal chelates known to the treating art as effective to catalyze the oxidation of mercaptans contained in a sour petroleum distillate with the formation of polysulfide oxidation products. Said metal chelates include the metal compounds of tetrapyridinoporphyrazine described in U.S. Pat. No. 3,980,582, e.g., cobalt tetrapyridinoporphyrazine; porphyrin and metaloporphyrin catalysts as described in U.S. Pat. No. 2,966,453, e.g., cobalt tetraphenylporphyrin sulfonate; corrinoid catalysts as described in U.S. Pat. No. 3,252,892, e.g., cobalt corrin sulfonate; chelate organometallic catalysts such as described in U.S. Pat. No. 2,918,426, e.g., the condensation product of an aminophenol and a metal of Group VIII; and the like. It is particularly preferred that metal phthalocyanines be used in the practice of the present invention.

The metal phthalocyanines which can be employed to catalyze the oxidation of mercaptans contained in sour petroleum distillates generally include magnesium phthalocyanine, titanium phthalocyanine, molybdenum phthalocyanine, manganese phthalocyanine, iron phthalocyanine, cobalt phthalocyanine, nickel phthalocyanine, platinum phthalocyanine, palladium phthalocyanine, copper phthalocyanine, silver phthalocyanine, zinc phthalocyanine, tin phthalocyanine, and the like. Cobalt phthalocyanine and vanadium phthalocyanine are particularly preferred. The metal phthalocyanine is most frequently employed as a derivative thereof, the commercially available sulfonated derivatives, e.g. cobalt phthalocyanine monosulfonate, cobalt phthalocyanine disulfonate or a mixture thereof being particularly preferred. The sulfonated derivatives may be prepared, for example, by reacting cobalt, vanadium or other metal phthalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine.

For use in the fixed bed treating operation, the metal chelate can be disposed on a carrier material in any conventional or otherwise convenient manner. In general, the carrier material in the form of spheres, pills, pellets, granules or other particles of uniform or irregular shape and size, is dipped, soaked, suspended or otherwise immersed in an aqueous or alcoholic solution and/or dispersion of the metal chelate catalyst, or the aqueous or alcoholic solution and/or dispersion may be sprayed onto, poured over or otherwise contacted with the carrier material. In any case, the aqueous solution and/or dispersion is separated, and the resulting composite is allowed to dry under ambient temperature conditions, or dried at an elevated temperature in an oven or in a flow of hot gases, or in any other suitable manner.

It is generally preferable to adsorb as much metal chelate on the carrier material as will form a stable catalytic composite—generally up to about 25 wt.% , although a lesser amount in the range of from about 0.1 to about 10 wt.% affords a suitably active catalytic composite. One suitable and convenient method comprises predisposing the carrier material in the distillate treating zone or chamber as a fixed bed, and passing the metal chelate solution and/or dispersion through the bed in order to form the catalytic composite it situ. This method allows the solution and/or dispersion to be recycled one or more times to achieve a desired concentration of the metal chelate on the carrier material. In still another method, the carrier material may be predisposed in said treating chamber and the chamber thereafter filled with the metal chelate solution and/or dispersion to soak the support for a predetermined period, thereby forming the catalytic composite in situ.

Pursuant to the present invention, offensive mercaptans contained in a sour petroleum distillate are oxidized to innocuous disulfides in the presence of the catalytic composite described above, a substituted ammonium compound, and a linear ionic compound.

The substituted ammonium compounds which can be employed in this invention are those compounds having four hydrocarbon radicals wherein each of said radicals comprises from about 1 to about 20 carbon atoms. Such substituted ammonium compounds include tetramethylammonium hydroxide, tetraethylammonium hydroxide, tetrapropylammonium hydroxide, tetrabutylammonium hydroxide, trimethylammonium hydroxide, trimethylpropylammonium hydroxide, trimethylbutylammonium hydroxide, dimethyldiethylammonium hydroxide, dimethyldipropylammonium hydroxide, dimethyldibutylammonium hydroxide, methyltriethylammonium hydroxide, methyltripropylammonium hydroxide, methyltributylammonium hydroxide, phenyltrimethylammonium hydroxide, phenyltriethylammonium hydroxide, phenyltripropylammonium hydroxide, phenyltributylammonium hydroxide, benzyltrimethylammonium hydroxide, benzyltriethylammonium hydroxide, benzyltripropylammonium hydroxide, benzyltributylammonium hydroxide, diphenyldimethylammonium hydroxide, diphenyldiethylammonium hydroxide, diphenyldipropylammonium hydroxide, diphenyldibutylammonium hydroxide, dibenzyldimethylammonium hydroxide, dibenzyldiethylammonium hydroxide, dibenzyldipropylammonium hydroxide, dibenzyldibutylammonium hydroxide, triphenylmethylammonium hydroxide, triphenylethylammonium hydroxide, triphenylpropylammonium hydroxide, triphenylbutylammonium hydroxide, and the like. Suitable anionic constituents include, in addition to the hydroxide ion, chloride, nitrate, nitrite, sulfate, phosphate, acetate, citrate, tartrate, and the like.

A preferred class of substituted ammonium compounds is represented by the structural formula:

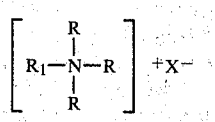

wherein R is a hydrocarbon radical containing up to about 20 carbon atoms and selected from the group consisting of alkyl, cycloalkyl, aryl, alkaryl and aralkyl, $R_1$ is a substantially straight chain alkyl radical containing from about 5 to about 20 carbon atoms, and X is an anion, for example, halide, hydroxide, nitrate, nitrite, sulfate, phosphate, acetate, citrate, tartrate, and the like. $R_1$ is preferably an alkyl radical containing from about 12 to about 18 carbon atoms, and X is preferably a halide or hydroxide. Especially preferred is a substituted ammonium hydroxide. Suitable substituted ammonium halides are described in U.S. Pat. No. 4,124,493. The particularly preferred substituted ammonium halide is a dimethylbenzylalkylammonium chloride. Substituted ammonium hydroxides which can give advantageous results include the hydroxides of the substituted ammonium halides listed in U.S. Pat. No. 4,124,493. The particularly preferred substituted ammonium hydroxide is dimethylbenzylalkylammonium hydroxide.

Particularly preferred substituted ammonium compounds are those represented by the structural formula set forth in the preceding paragraph wherein one of the R radicals is selected from the group consisting of aryl, aralkyl, and alkaryl. Especially preferred are substituted ammonium compounds wherein the $R_1$ straight chain alkyl radical contains from about 12 to about 18 carbon atoms, wherein one of the R groups is a benzyl radical, and wherein X is an hydroxide ion. Particularly preferred substituted ammonium hydroxides include those listed in U.S. Pat. No. 4,156,641.

The linear ionic compounds of this invention comprise straight chain compounds which dissociate to some degree in aqueous solution into cationic and anionic constituents. The anionic constituent preferably comprises an unbranched hydrocarbon having from about 9 to about 24 carbon atoms. The anionic constituent more preferably comprises a substantially saturated unbranched hydrocarbon having from about 9 to about 24 carbon atoms. It is especially preferred that the anionic constituent also comprise a sulfonate group, a sulfate group, or a carboxylate group. The cationic constituent may be any convenient cation. The linear ionic compound selected should be sufficiently soluble in aqueous solution to permit the formation of an aqueous solution comprising the selected substituted ammonium compound in a concentration of from about 0.01 wt. % to about 10 wt. % and the selected linear ionic compound in a concentration of from about 0.001 wt. % to about 10 wt. %. The preferred cationic constituents are the alkali metals and ammonium. Especially preferred is sodium.

Representative of saturated linear ionic compounds which can produce satisfactory results in this invention are sodium nonyl sulfate, sodium nonyl sulfonate, sodium nonyl carboxylate, sodium decyl sulfate, sodium decyl sulfonate, sodium decyl carboxylate, sodium undecyl sulfate, sodium undecyl sulfonate, sodium undecyl carboxylate, sodium dodecyl sulfate, sodium dodecyl sulfonate, sodium dodecyl carboxylate, sodium tridecyl sulfate, sodium tridecyl sulfonate, sodium tridecyl carboxylate, sodium tetradecyl sulfate, sodium tetradecyl sulfonate, sodium tetradecyl carboxylate, sodium pentadecyl sulfate, sodium pentadecyl sulfonate, sodium pentadecyl carboxylate, sodium hexadecyl sulfate, sodium hexadecyl sulfonate, sodium hexadecyl carboxylate, sodium heptadecyl sulfate, sodium heptadecyl sulfonate, sodium heptadecyl carboxylate, sodium octadecyl sulfate, sodium octadecyl sulfonate, sodium octadecyl carboxylate, sodium nonadecyl sulfate, sodium nonadecyl sulfonate, sodium nonadecyl carboxylate, sodium eicosyl sulfate, sodium eicosyl sulfonate, sodium eicosyl carboxylate, sodium heneicosyl sulfate, sodium heneicosyl sulfonate, sodium heneicoscyl carboxylate, sodium docosyl sulfate, sodium docosyl sulfonate, sodium docosyl carboxylate, sodium tricosyl sulfate, sodium tricosyl sulfonate, sodium tricosyl carboxylate, sodium tetracosyl sulfate, sodium tetracosyl sulfonate, and sodium tetracosyl carboxylate. As indicated above, cationic constituents such as ammonium and alkali metals other than sodium can provide satisfactory results. The preferred ionic compound is sodium dodecyl sulfate, commonly known as sodium lauryl sulfate.

Representative of unsaturated linear ionic compounds which can produce satisfactory results in the method of this invention are sodium nonenyl sulfate, sodium nonynl sulfate, sodium nonadienyl sulfate, sodium decenyl sulfate, sodium decynal sulfate, sodium decadienyl sulfate, sodium undecenyl sulfate, sodium undecynl sulfate, sodium undecadienyl sulfate, sodium dodecenyl sulfate, sodium dodecynl sulfate, sodium dodecadienyl sulfate, sodium tridecenyl sulfate, sodium tridecynl sulfate, sodium tridecadienyl sulfate, sodium tetradecenyl sulfate, sodium tetradecynl sulfate, sodium tetradienyl sulfate, sodium pentadecenyl sulfate, sodium pentadecynl sulfate, sodium pentadienyl sulfate, sodium hexadecenyl sulfate, sodium hexadecynl sulfate, sodium hexadienyl sulfate, sodium heptadecenyl sulfate, sodium heptadecynl sulfate, sodium heptadienyl sulfate, sodium octadecenyl sulfate, sodium octadecynl sulfate, sodium octadienyl sulfate, sodium nonadecenyl sulfate, sodium nonadecynl sulfate, sodium nonadienyl sulfate, sodium eicosadecenyl sulfate, sodium eisoadecynl sulfate, sodium eicosadienyl sulfate, sodium heneicosadecenyl sulfate, sodium heneicosadecynl sulfate, sodium heneicosadienyl sulfate, sodium docosadecenyl sulfate, sodium docasadecynl sulfate, sodium docosadienyl sulfate, sodium tricosadecenyl sulfate, sodium tricosadecynl sulfate, sodium tricosadienyl sulfate, sodium tetracosadecenyl sulfate, sodium tetracosadecynl sulfate, and sodium tetracosadienyl sulfate. Other unsaturated linear ionic compounds which can produce satisfactory results include the sulfonate and carboxylate analogues of the foregoing sulfates. Cationic constituents such as ammonium and alkali metals other than sodium can provide satisfactory results.

The linear ionic compounds are easily prepared by well known methods from several precursors, including alcohols, acids, and olefins. For example, a linear carboxylate salt can be prepared from the analogous carboxylic acid, which itself is commonly prepared from animal and vegetable fats. Thus, sodium laurate is formed by the reaction of lauric acid and sodium hydroxide. Linear sulfates can be prepared by the reaction of sulfuric acid with the corresponding olefin or alcohol. Thus, lauryl alcohol reacts with sulfuric acid to form lauryl hydrogen sulfate, which can be neutralized with sodium hydroxide to form sodium lauryl sulfate.

Similarly, the reaction of the corresponding olefin with sulfuric acid produces the hydrogen sulfate, which can be neutralized to the sodium sulfate compounds. The sulfonate can be prepared by the reaction of sulfuric acid with the corresponding alkane, to produce a sulfonic acid which can be neutralized to a sulfonate salt. Alternatively, an alkyl sulfonic acid can be neutralized with sodium hydroxide to form the corresponding sodium alkyl sulfonate. Still another alternative is the sulfonation of an alkyl halide to form the desired compound.

The method of this invention comprises treating a mercaptan-containing sour petroleum distillate by contacting said distillate at oxidation conditions with a mercaptan oxidation catalyst in the presence of a linear ionic compound and a substituted ammonium compound. It is contemplated that the contacting is effected in the presence of an alkaline agent. The alkaline agent can be introduced into the treating zone by any conventional or convenient means. One particularly convenient means of introducing the alkaline agent into the reaction zone is by intermittent or continuous injection of the alkaline agent into the petroleum distillate to be treated prior to or simultaneously with the contacting of the distillate with the mercaptan oxidation catalyst. In a fixed-bed treating operation, the catalytic composite is initially saturated with an alkaline agent, and an alkaline agent thereafter passed in contact with the catalyst bed, continuously or intermittently as required, admixed with the sour petroleum distillate. Any suitable alkaline agent may be employed. An alkali metal hydroxide in aqueous solution, e.g., sodium hydroxide in aqueous solution, is most often employed. The solution may further comprise a solubilizer to promote mercaptan solubility, e.g., alcohol, and especially methanol, ethanol, n-propanol, etc., and also phenols, cresols, and the like. The solubilizer, when employed, is preferably methanol, and the alkaline solution may suitably comprise from about 2 to about 100 vol.% thereof. Sodium hydroxide and potassium hydroxide constitute the preferred alkaline agents. Others including lithium hydroxide, rubidium hydroxide and cesium hydroxide are also suitably employed.

The linear ionic compound and the substituted ammonium compound can be introduced into the reaction zone by any convenient or conventional means, either in common solution or sequentially. One particularly convenient method comprises introducing the linear ionic compound and the substituted ammonium compound into the reaction zone in a common solution with the alkaline agent. In a fixed-bed treating operation, the catalytic composite is initially saturated with an alkaline agent, and a common solution of alkaline agent. Linear ionic compound, and substituted ammonium compound thereafter passes in contact with the catalyst bed, continuously or intermittently as required, admixed with the sour petroleum distillate. Alternatively, the catalytic composite can be saturated with the common solution of alkaline agent, linear ionic compound, and substituted ammonium compound, and the common solution thereafter passes in contact with the catalyst bed as above described. The latter method is especially suited to the treatment of sour petroleum distillates which are particularly difficult to treat by other means.

The method of this invention contemplates that the linear ionic compound and the substituted ammonium compound are introduced into the reaction zone in solution. The solution can be a common solution of alkaline agent, linear ionic compound, and substituted ammonium compound. Alternatively, the linear ionic compound and the substituted ammonium compound can be in common solution separate from the alkaline agent. A third alternative is that the linear ionic compound and the substituted ammonium compound be in separate solutions. The relative amounts of linear ionic compound and substituted ammonium compound can vary widely and still yield advantageous results. Generally, it is preferred that the linear ionic compound and the substituted ammonium compound be in a weight ratio of from about 1:25 to about 25:1. It is especially preferred that the linear ionic compound and the substituted ammonium compound be in a weight ratio of from about 1:20 to about 1:1.

The linear ionic compound and the substituted ammonium compound are conveniently employed as aqueous or alcoholic solutions, or as a common aqueous or alcoholic solution, in instances in which a common solution of an alkaline agent, linear ionic compound, and substituted ammonium compound is not employed. The linear ionic compound and the substituted ammonium compound are suitably effective in molar concentrations of from about 0.0001 to about 5. It is preferred that the linear ionic compound and the substituted ammonium compound be maintained in a concentration of from about 0.1 ppm by weight to about 500 ppm by weight, relative to the sour petroleum distillate being treated.

The method of treating in this invention can be effected in accordance with prior art treating conditions. The process is usually effected at ambient temperature conditions, although higher temperatures up to about 105° C. are suitably employed. Pressures of up to about 1,000 psi or more are operable, although atmospheric or substantially atmospheric pressures are entirely suitable. Contact times equivalent to a liquid hourly space velocity of from about 0.5 to about 10 or more are effective to achieve a desired reduction in the mercaptan content of a sour petroleum distillate, an optimum contact time being dependent on the size of the treating zone, the quantity of catalyst contained therein, and the character of the distillate being treated.

As previously stated, sweetening of the sour petroleum distillate is effected by oxidizing the mercaptan content thereof to disulfides. Accordingly, the process is effected in the presence of an oxidizing agent, preferably air, although oxygen or other oxygen-containing gas may be employed. In fixed bed treating operations, the sour petroleum distillate may be passed upwardly or downwardly through the catalyst composite. The sour petroleum distillate may contain sufficient entrained air, but generally added air is admixed with the distillate and charged to the treating zone concurrently therewith. In some cases, it may be of advantage to charge the air separately to the treating zone and countercurrent to the distillate separately charged thereto.

The following examples are presented in illustration of the preferred embodiments of this invention and are not intended as undue limitations on the generally broad scope of the invention as set out in the appended claims.

EXAMPLE I

This example illustrates a preferred embodiment of the method of this invention. A sour kerosine feedstock boiling in the 352°–454° F. range and containing about 450 ppm mercaptan sulfur is converted to a doctor sweet product on charging the same downflow through a charcoal-supported cobalt phthalocyanine monosulfonate catalyst at an LHSV of about 0.5—said catalyst being disposed as a fixed bed in a vertical tubular reactor. The catalyst bed consists of about 1 wt.% cobalt phthalocyanine monosulfonate adsorbed on 10–30 mesh activated charcoal particles. The sour kerosine is charged under about 45 psig. of air—sufficient to provide about twice the stoichiometric amount of oxygen required to oxidize the mercaptan content of the kerosine. Pursuant to one preferred embodiment of this invention, the cataylst bed is initially wetted with a solution of 2 molar aqueous dimethylbenzylalkylammonium hydroxide and 0.2 molar aqueous sodium lauryl sulfate. About 10 cc of said solution per 100 cc of catalyst is subsequently added to the catalyst bed at 12 hour intervals admixed with the sour kerosine charged thereto. The dimethylbenzylalkylammonium hydroxide employed comprises a mixture of dimethylbenzyldodecylammonium hydroxide, dimethylbenzyltetradecylammonium hydroxide, dimethylbenzylhexadecylammonium hydroxide and dimethylbenzyloctadecylammonium hydroxide.

EXAMPLE II

This example illustrates another embodiment of the method of this invention. In this example, a mercaptan-containing sour kerosine distillate was treated in contact with a supported monosulfonated cobalt phthalocyanine catalyst in the presence of dimethylbenzylalkylammonium chloride and sodium lauryl sulfate.

The catalytic composite originally consisted of about 0.5 wt.% cobalt phthalocyanine monosulfonate and about 18 wt.% quaternary ammonium chloride, disposed on 10–30 mesh activated charcoal particles of an apparent bulk density of about 0.25 gm/cc. The catalytic composite was used to treat a mercaptan-containing sour petroleum distillate, without addition of a linear ionic compound or a substituted ammonium compound, until the catalytic composite had been partially deactivated and the kerosine product contained about 40 ppm by weight mercaptan sulfur. The catalytic composite was disposed as a fixed bed in a vertical tube, and flushed with about 600 cc of water at about 100° C. to remove gum and other contaminants. Thereafter, 125 cc of a solution comprising 0.15 gm of commercial grade (about 85% purity) monosulfonated cobalt phthalocyanine, 0.09 gm of sodium lauryl sulfate, 1 cc of 27 wt.% aqueous ammonia, and the balance deionized water, was charged down-flow through the catalyst bed, and recycled until it lost substantially all of its color. Thereafter, about 600 cc of a solution comprising 1.0 gm of mixed benzyldimethylalkylammonium hydroxides, wherein the alkyl substituent was a straight chain $C_{12}$–$C_{18}$ alkyl substituent, in water at a temperature of about 100° C., was charged down-flow through the catalyst bed. The catalyst bed was wetted with about 10 cc of a 7 wt.% aqueous caustic solution, 10 cc of said solution being subsequently charged to the catalyst bed at about 12 hour intervals admixed with the kerosine charged thereto.

The catalytic composite was thereafter used to treat a sour kerosine fraction having an end-boiling point of 486° F. and containing 873 ppm by weight mercaptan sulfur. The kerosine was charged down-flow through 100 cc of the catalytic composite disposed as a fixed bed in a vertical tubular reactor, the kerosine being charged at a liquid hourly space velocity of about 0.5 under 45 psig of air—sufficient to provide about 1.5 times the stoichiometric amount of oxygen required to oxidize the mercaptans contained in the kerosine.

During the course of the run, the mercaptan sulfur content increased as the activity of the catalytic composite decreased. When the mercaptan sulfur content of the treated kerosine reached about 11 ppm by weight, the operation of the test was altered to conform to one embodiment of the method of this invention. The intermittent charging of 10 cc of 7 wt.% aqueous caustic solution was discontinued, and thereafter 10 cc of an aqueous solution comprising 7 wt.% caustic and mixed benzyldimethylalkylammonium hydroxides, the alkyl substituent being a straight chain $C_{12}$–$C_{18}$ alkyl, in a concentration of 2 grams per liter of solution, and sodium lauryl sulfate in a concentration of 0.25 gram per liter of solution, was charged to the catalyst bed at about 24 hour intervals admixed with the kerosine charged thereto. The treated kerosine was analyzed periodically for mercaptan sulfur. The mercaptan sulfur level of the treated kerosine dropped to about 5 ppm by weight, and remained at that level for about 300 hours, until the run was terminated. There was no evidence to indicate that the mercaptan sulfur level of the product would have increased had the run continued.

This example illustrates the advantageous results which can be obtained by the method of this invention. The prior art predicts that over time mercaptan sulfur level of the product of a treating process would increase as the catalyst becomes deactivated. The unexpected and desirable result shown by this example is twofold. The method of this invention is able to produce a treated product of very low mercaptan sulfur content relative to the mercaptan sulfur level of the feedstock. The method of this invention also is able to produce a product of low mercaptan sulfur level over a substantial period of time without evidence of catalytic deactivation or product degradation. It is particularly notable that these results are obtained with respect to a catalytic composite which had been partially deactivated twice prior to beginning the practice of the method of this invention.

It is also notable that the advantageous results achieved are not dependent upon the continuous or intermittent addition of the metal chelate constituent of the catalytic composite. It should be understood, however, that the method of this invention does not preclude the addition of a metal chelate to the reaction zone. Advantageous results may be realized by the addition to the reaction zone of metal chelate in some cases, including the treating of stocks which are extremely difficult to treat effectively by other means, and the treating of stocks using a catalytic composite which has become substantially deactivated as a result of long term use, exposure to deactivating agents, or for other reasons.

I claim as my invention:

1. A method of treating a mercaptan-containing sour petroleum distillate which comprises contacting said distillate with an elemental oxygen-containing gas and a mercaptan oxidation catalyst in the presence of additive consisting essentially of both (1.) a substituted ammonium compound represented by the structural formula:

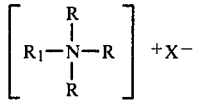

wherein R is a hydrocarbon radical containing up to 20 carbon atoms selected from the hydrocarbon radicals of alkyl, cycloalkyl, aryl, alkaryl and aralkyl, $R_1$ is a substantially straight chain alkyl radical containing from about 5 to about 20 carbon atoms, and X is an anion selected from the group consisting of halide, nitrate, nitrite, sulfate, phosphate, acetate, citrate, tartrate and hydroxide and (2.) an organic linear ionic compound having anionic and cationic constituents, the anionic constituent being a straight chain unbranched hydrocarbon moiety having from about 9 to about 24 carbon atoms in said chain and a moiety selected from the group consisting of a sulfonate, sulfate and carboxylate moiety, the cationic constituent selected from the group consisting of an alkai metal and ammonium, wherein the weight ratio of said organic linear ionic compound and said substituted ammonium compound is from about 1:20 to about 1:1 to oxidize said mercaptans in said sour petroleum distillate.

2. The method of claim 1 wherein said substituted ammonium compound is a benzyldimethylalkylammonium hydroxide wherein the alkyl substituent is a substantially straight chain alkyl radical containing from about 5 to about 20 carbon atoms.

3. The method of claim 1 wherein said substituted ammonium compound is a benzyldimethylalkylammonium hydroxide wherein the alkyl substituent is a substantially straight chain alkyl radical containing from about 12 to about 18 carbon atoms.

4. The method of claim 1 wherein said substituted ammonium compound is a substituted ammonium halide.

5. The method of claim 1 wherein said organic linear ionic compound comprises a substantially saturated unbranched ionic compound having from about 9 to about 24 carbon atoms.

6. The method of claim 1 wherein said organic linear ionic compound is selected from the group consisting of sodium undecyl sulfate, sodium dodecyl sulfate, and sodium tridecyl sulfate.

7. The method of claim 1 wherein said mercaptan oxidation catalyst is a metal phthalocyanine disposed on a carrier material.

8. The method of claim 1 wherein said mercaptan oxidation catalyst is a metal phthalocyanine disposed on an activated charcoal support.

9. The method of claim 1 wherein said mercaptan oxidation catalyst is a cobalt phthalocyanine.

10. The method of claim 1 wherein said mercaptan oxidation catalyst is cobalt phthalocyanine monosulfonate.

11. The method of claim 1 wherein said mercaptan oxidation catalyst comprises from about 0.1 wt. % to about 10 wt. % metal phthalocyanine disposed on a carrier material.

12. The method of claim 1 wherein said substituted ammonium compound and said organic linear ionic compound are present in amounts equivalent to from about 0.1 to about 500 ppm based on the weight of the sour petroleum distillate.

13. The method of claim 1 wherein said sour petroleum distillate is contacted with said mercaptan oxidation catalyst at a liquid hourly space velocity of from about 0.1 to about 10.

* * * * *